US007981004B2

(12) United States Patent
Liggett et al.

(10) Patent No.: US 7,981,004 B2
(45) Date of Patent: Jul. 19, 2011

(54) ELEVATED ADVENTURE COURSE

(76) Inventors: James Allen Liggett, Allegan, MI (US); Troy Garland, Pullman, MI (US)

( * ) Notice: Subject to any disclaimer, the term of this patent is extended or adjusted under 35 U.S.C. 154(b) by 382 days.

(21) Appl. No.: 11/852,738

(22) Filed: Sep. 10, 2007

(65) Prior Publication Data

US 2009/0065300 A1 Mar. 12, 2009

(51) Int. Cl.
*A63B 21/00* (2006.01)

(52) U.S. Cl. ..... 482/35; 482/33; 482/34; 482/36; 482/38; 482/37

(58) Field of Classification Search ..... 482/33–38
See application file for complete search history.

(56) References Cited

U.S. PATENT DOCUMENTS 7,175,534 B2 * 2/2007 Liggett ..... 472/15
* cited by examiner

*Primary Examiner* — Jerome W Donnelly
(74) *Attorney, Agent, or Firm* — Robert J. SayFie

(57) ABSTRACT

An elevated adventure course, having an entrance-exit platform connected to a support member; a tracking member secured to a top portion of the support member; an element secured to said support member; and a path defined by a plurality of the elements that leads to a second entrance-exit platform.

2 Claims, 2 Drawing Sheets

ELEVATED ADVENTURE COURSE

FIELD OF THE INVENTION

This invention relates to an apparatus in which participants are challenged to walk or scale various elements while elevated above the ground, which can test the participant's skills such as confidence or group problem solving.

BACKGROUND OF THE INVENTION

Challenge courses are structures that allow a person or team to challenge themselves by participating in various events such as walking along swinging ropes or planks, at elevated heights. These courses are also used to train military personnel. These courses are also used at recreational parks or other such centers that have go-carts and miniature golf.

The invention is an elevated adventure course, or elevated challenge course that can be placed so as to enable users to traverse above ground and traverse in an arbitrary and varied path.

The challenge courses in the prior art are generally positioned in one general location, and users generally walk up to the set of elements, and traverse along elements arranged next to, perpendicular to, or parallel to the other elements.

There exists a need for an adventure course that can be placed in a park or zoo, or other large area, that enabled viewers to challenge themselves; and also be able to view the grounds below, while being secured by the safety cable of the adventure course or challenge course.

There also exists the need to increase the flow and capacity of participants walking through a park or zoo to allow for increased traffic flow.

Multiple embodiments of the system are disclosed herein. It will be understood that other objects and purposes of the invention, and variations thereof, will be apparent upon reading the following specification and inspecting the accompanying drawings.

REFERENCE NUMERALS LIST

10 elevated adventure course
20 entrance-exit area
22 second entrance-exit area
30 entrance-exit platform
40 support member
45 top portion
50 tracking member
60 element
70 standing area
80 tracking member
90 vertical member
100 path
210 entrance-exit tracking member
230 are
240 rope
250 base
260 guide aperture
270 guide
280 entrance-exit support structure
300 non-linear path

SUMMARY OF THE INVENTION

One aspect of the present invention is An elevated adventure course, comprising: an entrance-exit platform (30) connected to a support member (40); a tracking member (50) secured to a top portion (45) of said support member (40); an element (60) secured to said support member (40); and a path (100) defined by a plurality of said elements (60) that leads to a second entrance-exit area (22).

Another aspect of the present invention is An elevated adventure course (10), comprising: an entrance-exit platform (30) connected to a support member (40); a tracking member (50) secured to a top portion (45) of said support member (40); an element (60) secured to said support member (40); a path (100) defined by a plurality of said elements (60); a second tracking member (80) secured to a top portion (45) of said support member (40); said second tracking member (80) disposed substantially parallel with said tracking member (50); an entrance-exit area (20) having an entrance-exit support structure (280); an entrance-exit tracking member (210) secured at one end to said entrance-exit support structure (280), and secured at another end to said support member (40); a plurality of arms (230) secured to said entrance-exit tracking member (210); a rope (240) extending downwardly from said arm (230); and a base (250) secured to said rope (240); whereby the plurality of ropes (240) define a non-linear pathway (300) that leads to a second entrance-exit area (22).

Another aspect of the present invention is a method of traversing along an elevated challenge course comprising the steps of: providing an entrance-exit platform (30) connected to a support member (40); providing a tracking member (50) secured to a top portion (45) of said support member (40); providing an element (60) secured to said support member (40); and providing a second tracking member (80) secured to a top portion (45) of said support member (40); said second tracking member (80) disposed substantially parallel with said tracking member (50); and a path (100) defined by a plurality of said elements (60) that leads to a second entrance-exit area (22).

These and other features, aspects and advantages of the present invention will become better understood with reference to the following drawings, description and claims.

DETAILED DESCRIPTION OF THE INVENTION

Figure 1:
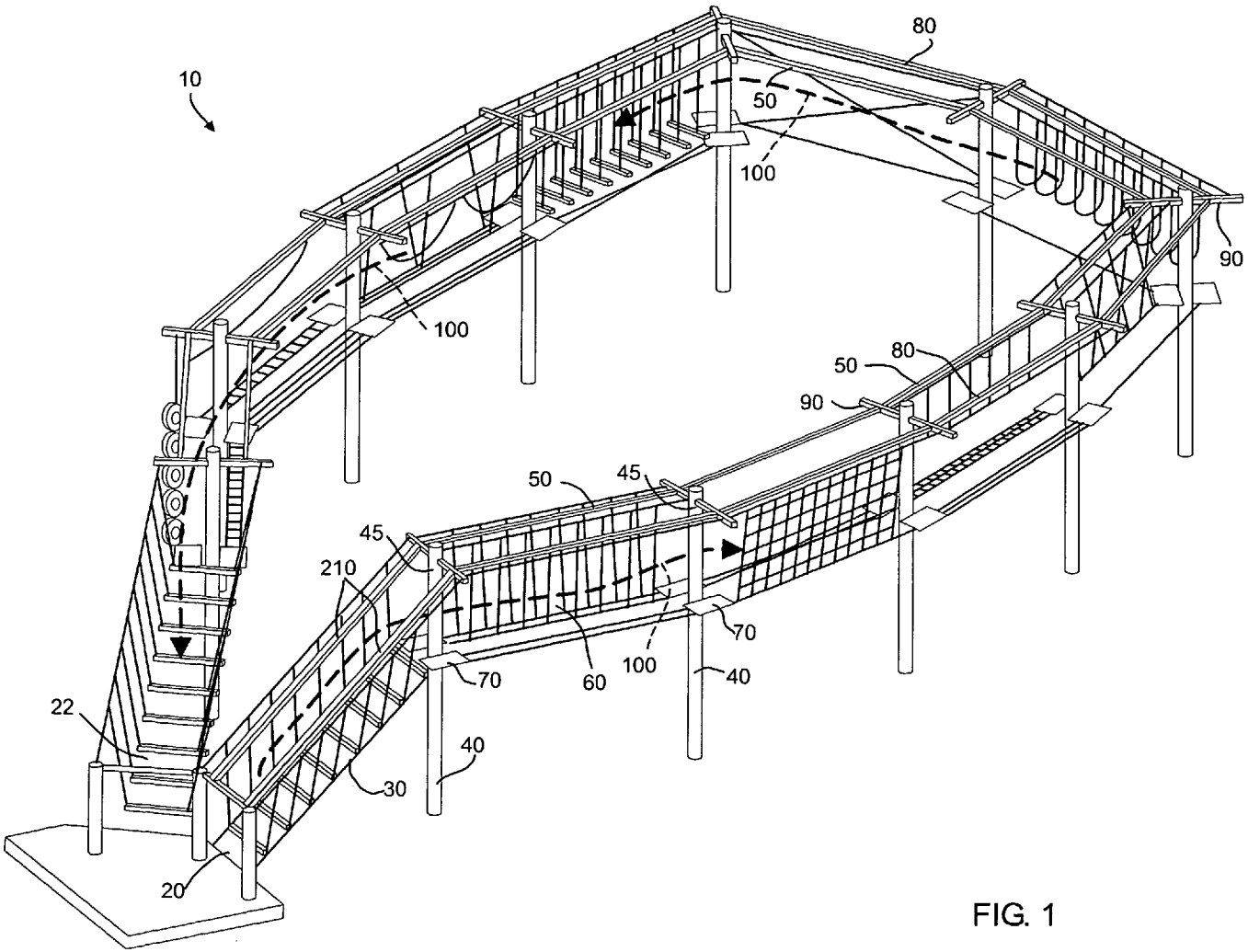
FIG. 1 is a pictorial view of one embodiment of the present invention in its deployed position.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to," "secured to," or similar language includes the definitions "indirectly connected to," "directly connected to," "indirectly secured to," and "directly secured to."

FIG. 1 illustrates one embodiment of the present invention. The elevated adventure course, which may also be referred to as an elevated challenge course 10 may have an entrance-exit area 20 that leads to a entrance-exit platform 30. In one embodiment the entrance-exit platform 30 may be a ramp. In a further embodiment the entrance-exit platform may be a may be a stairway. The entrance-exit platform 30 may be connected to a support member 40. The support member 40 may extend upwardly from the entrance-exit platform 40 to define a top portion 45.

A tracking member 50, 80 may be secured to the top portion 45. In one embodiment the tracking member 50, 80 may be connected to a vertical member 90. An element 60 may be disposed below the tracking member 50, 80 and the element 60 may be connected to a support member 40. A standing area 70 may be supported by the support member 40.

The vertical member 90 may be secured to the top portion 45.

In one embodiment, several support members 40 are employed to allow participants to walk on several adjacent elements 60 along a path 100 created by the placement of the support members 40 and elements 60.

The tracking member 50 may be the type as disclosed is U.S. Patent Publication No. 2006/0090960 ("the 960 publication"); which is described in the abstract as "[a]n apparatus and method of traversing across elements of a challenge course by use of a tracking system that can continuously retain the harness cable that descends to the participant, as the moveable member moves in a substantially horizontal direction along the safety cables, or along the tracks of the moveable member exchange frame."

As illustrated in FIG. 1, the tracking member 50, 80 may be disposed above the elements 60, and other areas that the participant may traverse. The tracking member 50, 80 may movably retain or movably hold a safety cable therein, to secure the participant via cables, belts, or a safety harness, as described in the 960 publication.

Although not illustrated, the tracking member 50, 80 may be disposed above the entrance-exit platform 30 at substantially the same angle as the entrance-exit platform 30. In other words, the tracking member 50 80 may be substantially parallel with the entrance-exit platform 30 so that participant maintains about the same distance from the tracking member 50, 80. This way, the participant may be secured with the tracking member 50, 80 at the point in which they ascend or descent while on the entrance-exit platform 30.

As illustrated in FIG. 1, two tracking members 50, 80 are illustrated. This enables participants to traverse in one direction along, for example, tracking member 50, while other participants may traverse in the opposite direction along tracking member 80.

Figure 2:
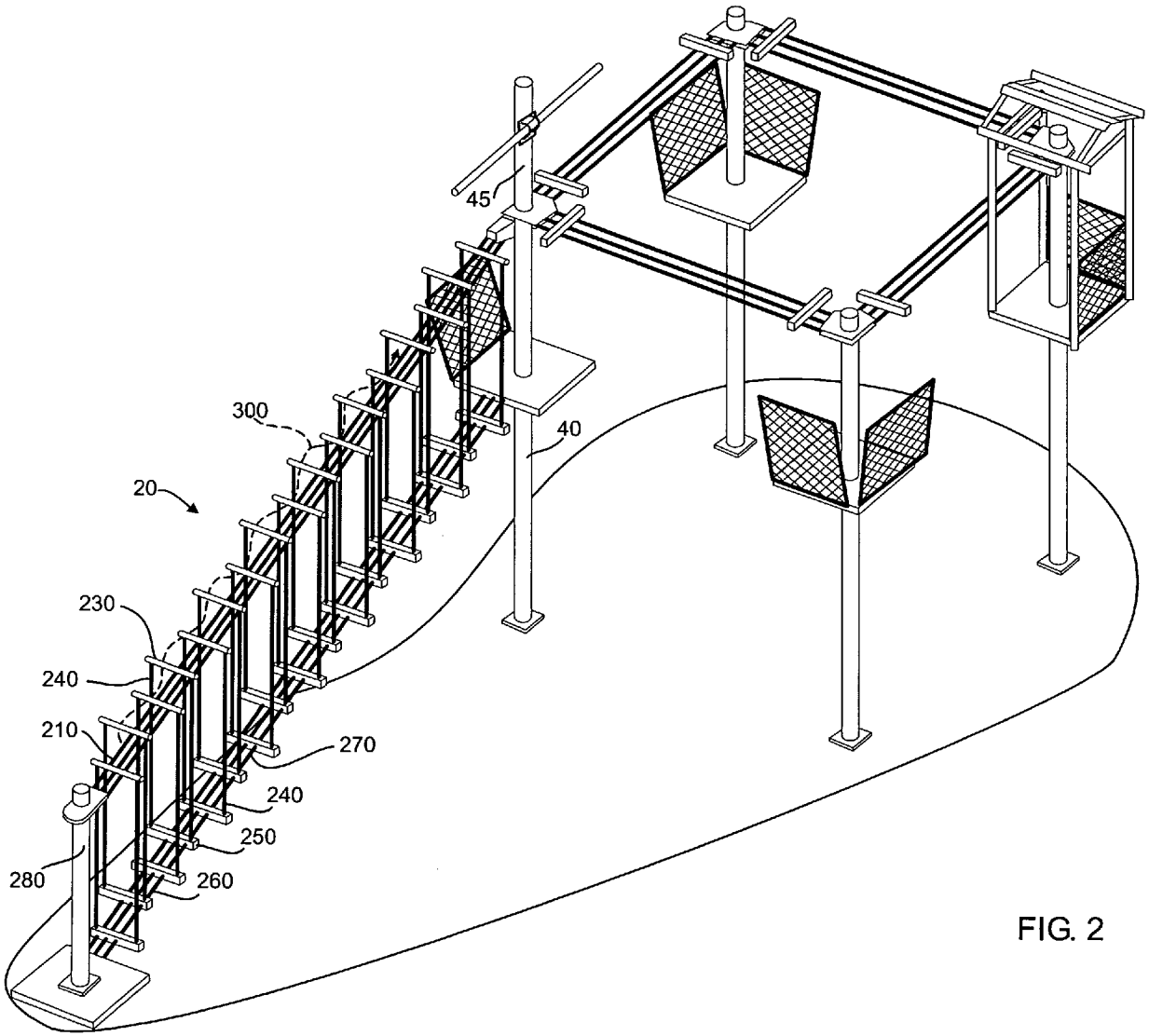
FIG. 2 is a pictorial view of the entrance-exit portion of one embodiment of the present invention.

FIG. 2 illustrates in detail the entrance-exit area 20. An entrance-exit tracking member 210 is secured to an entrance-exit support structure 280 at one end, and to a support member 40 at the other end. An arm 230 may be secured to the entrance-exit tracking member 210. Multiple arms 230 that have substantially the same size may be secured to the entrance-exit tracking member 210 in such a way as to define a non-linear path 300.

The arm 230 may have a rope 240 secured thereto. The rope 240 extending downwardly from the arm 230 to connect to a base 250, whereby a participant can stand on the base 250, and hang on to a rope 240. And when traversing several bases 250, the participant would walk in a non-linear path 300 while the participant is hooked into the tracking member 50, 80 with an appropriate harness or cable. The base 250 may have a base-aperture 260 to receive a guide 270 therethrough.

It should be understood, of course, that the foregoing relates to exemplary embodiments of the invention and that modifications may be made without departing from the spirit and scope of the invention as set forth in the following claims.

We claim:

1. An elevated adventure course (10), comprising:

an entrance-exit area (20) having an entrance-exit platform (30) connected to a support member (40);

a tracking member (50) secured to a top portion (45) of said support member (40);

an element (60) secured to said support member (40); and a path (100) defined by a plurality of said elements (60) that leads to a second entrance-exit area (22);

said entrance-exit area (20) having an entrance-exit support structure (280);

an entrance-exit tracking member (210) secured at one end to said entrance-exit support structure (280), and secured at another end to said support member (40);

a plurality of arms (230) secured to said entrance-exit tracking member (210);

a rope (240) extending downwardly from said arm (230); and a base (250) secured to said rope (240);

whereby the plurality of ropes (240) define a non-linear pathway (300).

2. An elevated adventure course (10), comprising:

an entrance-exit platform (30) connected to a support member (40);

a tracking member (50) secured to a top portion (45) of said support member (40);

an element (60) secured to said support member (40);

a path (100) defined by a plurality of said elements (60);

a second tracking member (80) secured to a top portion (45) of said support member (40); said second tracking member (80) disposed substantially parallel with said tracking member (50);

an entrance-exit area (20) having an entrance-exit support structure (280);

an entrance-exit tracking member (210) secured at one end to said entrance-exit support structure (280), and secured at another end to said support member (40);

a plurality of arms (230) secured to said entrance-exit tracking member (210);

a rope (240) extending downwardly from said arm (230); and a base (250) secured to said rope (240);

whereby the plurality of ropes (240) define a non-linear pathway (300) that leads to a second entrance-exit area (22).

* * * * *